US005477995A

United States Patent [19]

Dooley et al.

[11] Patent Number: 5,477,995

[45] Date of Patent: Dec. 26, 1995

[54] METHOD AND APPARATUS FOR ASSEMBLING SIZE-INDICATORS TO GARMENT HANGERS

[75] Inventors: Edward J. Dooley, Holland; Robert Bredeweg; Russell O. Blanchard, both of Zeeland, all of Mich.

[73] Assignee: Batts, Inc., Zeeland, Mich.

[21] Appl. No.: 161,710

[22] Filed: Dec. 3, 1993

[51] Int. Cl.[6] ..... A47G 25/14; G09F 3/00; B65H 3/58; B65D 73/00

[52] U.S. Cl. ..... 223/85; 40/322; 221/26; 227/109; 206/459.1

[58] Field of Search ..... 223/85, 88, 92, 223/95; 221/26, 185, 217; 206/39.5, 459.5, 303; 40/322, 316; 227/109, 135

[56] References Cited

U.S. PATENT DOCUMENTS

| | | | |
|---|---|---|---|
| 2,768,775 | 10/1956 | Houser | 224/5 |
| 3,248,007 | 4/1966 | Hulderstrum | 221/185 |
| 3,485,889 | 11/1974 | Hurd | 224/16 |
| 3,543,681 | 12/1970 | Klenz | 101/44 |
| 4,733,460 | 3/1988 | Auger et al. | 221/312 C |
| 5,143,252 | 9/1992 | Shi | 221/185 |

FOREIGN PATENT DOCUMENTS

| | | | |
|---|---|---|---|
| 2551688 | 9/1983 | France | 227/109 |
| 2543333 | 9/1984 | France | 40/642 |
| 2654081 | 8/1989 | France | 206/26 |
| 427742 | 7/1967 | Switzerland | 40/642 |

*Primary Examiner*—C. D. Crowder
*Assistant Examiner*—Bibhu Mohanty
*Attorney, Agent, or Firm*—Baker & McKenzie

[57] ABSTRACT

An applicator is provided for the installation of size-indicating tabs on garment hangers. The applicator facilitates the installation of small, non-reusable, child-proof size-indicating tabs on garment hanger specially equipped to accommodate the tabs. The applicator includes a tube-like structure with a tapered outlet and a means for advancing a stick or coil of tabs forward in the tube. One preferred applicator includes multiple tubes attached to one another in a side-by-side fashion so that the operator may choose between a small, medium, large and extra-large size-indicating tabs.

18 Claims, 2 Drawing Sheets

METHOD AND APPARATUS FOR ASSEMBLING SIZE-INDICATORS TO GARMENT HANGERS

FIELD OF THE INVENTION

This invention relates generally to an improved system for indicating the size of a garment suspended from a garment hanger. More particularly, this invention relates to an improved system for attaching size-indicating tabs on to garment hangers specifically adapted to accommodate said tabs. The system includes an applicator designed to accommodate a strip of tabs connected in an end-to-end fashion. The applicator is then used to attach tabs to garment hangers one at a time.

BACKGROUND OF THE INVENTION

The concept of a garment hanger that includes a label for indicating the size of the garment hung thereon is well-known. Modern safety standards require that size-indicating tabs be irremovable once installed on a hanger. From the standpoint of safety, if a small tab can be easily removed from a hanger, the tab may become lodged in a child's throat.

However, another problem has arisen in the wake of the development of permanently attached size-indicating tabs. Specifically, the tabs are difficult to attach to the hangers; the attachment process requires the tab to be grasped, twisted and pushed onto the tab-holding section of the hanger. Assembly-line workers charged with the task of attaching the tabs to the hangers may develop carpal tunnel syndrome as a result of the twisting and pushing action required to install the tabs on the hangers. Further, the tabs are small and difficult to handle and therefore the time required to attach the tabs to the hangers can be inefficiently long.

Until now, assembly-line workers were required to pick up the small tabs individually and snap them on to the tab-holding sections of the garment hangers by hand. Accordingly, it would be desirable to provide an improved applicator to assist the assembly-line workers in installing the tabs. Further, it would be desirable to provide the tabs in long strips or coils that are easier for the assembly-line workers to handle.

SUMMARY OF THE INVENTION

The present invention makes a significant contribution to the garment hanger art by providing an improved system for installing size-indicating tabs on garment hangers. The hanger resulting from the present invention is faster and easier to manufacture and limits the amount of grasping, twisting and pushing required on the part of the assembly-line worker which may lead to the development of carpal tunnel syndrome. The present invention may be used with size-indicating tabs that are child-proof. Further, the present invention reduces the time required to install each tab thereby reducing the cost of using size-indicating tabs on garment hangers.

The present invention features an applicator for attaching the size-indicating tabs to a garment hanger. The tabs are provided in stick or coil form which include a series of tabs connected to each other in an end-to-end fashion. Slits or cuts in the opposing side members of the tabs provide an easy break point for the separation of the tabs when they are being applied to the garment hangers. As shown below, as the opposing side members of the tab engage a tab-holding section of a garment hanger, the tab breaks off from the stick or coil of tabs.

The applicator for attaching the size-indicating tabs includes a tube with an outlet. The tube includes a means for advancing the stick of tabs so the operator can move the stick of tabs forward to provide one tab extending out through the outlet of the applicator in preparation to mount the tab on a garment hanger. The interior surface of the tube is configured so as to prevent any twisting or turning of the stick of tabs inside of the tube. Any twisting or turning of the stick or coil of tabs inside the tube would make it more difficult to line the tab up prior to installation.

The preferred means for advancing a stick of tabs to extend one tab out through the outlet of the tube is a slot or opening disposed in the upper side of the tube. The operator can use a thumb or forefinger to advance the sticker coil of tabs forward to provide one tab extending out through the outlet of the tube. The outlet of the tube includes an upper edge which is used to push the tube on to the tab-holding section of the garment hanger and further which is used to break the tab off of the stick or coil of tabs. The preferred configuration of the tube outlet slants rearward from the upper edge to the lower edge. The configuration of the rearwardly spaced lower edge precludes interference of the lower edge with the garment support member of the hanger during installation of the tab.

The preferred applicator includes three or even four tubes connected to each other in a side-by-side relationship or juxtaposed relationship with respect to each other. The tubes may then accommodate small, medium, large and extra large size-indicating tabs. Each tube includes an outlet and all outlets are disposed adjacent to each other in a side-by-side relationship. Each tube also includes a means for advancing the stick of tabs forward so one tab would extend through the outlet of its respective tube prior to mounting on to the tab-holding section of the garment hanger. Again, the preferred means for advancing the stick of tabs forward is a slot or opening disposed in the upper surface of each tube. Of course, more mechanical means of advancing the stick of tabs forward will be apparent to those skilled in the art. The slot or opening would also allow the operator to see the front display surface of the tabs thereby identifying each coil of tabs as small, medium, large or extra large size-indicating tabs.

The applicator, garment hanger and tabs provided in coil or stick form provide an effective combination. Specifically, the preferred garment hanger includes a hook or hang means connected to a garment support member. The tab-holder is disposed between the garment support member and the hang means and preferably connected to one or both of the garment support member and the hang means. A wall extends outward along one side of the garment support member and connects the tab-holder to the hanger. The wall terminates at the tab-holder. The preferred tab-holder terminates in a tapered front end and a flared base end. The size-indicating tab is accommodated over the tab-holder.

The applicator enables the assembly-line worker to line up the open end of the C-shaped size-indicating tab with the tab-holder and press the tab that extends out of the outlet of the tube onto the tab-holder thereby spreading the opposing side members and snapping the tab on to the tab-holder. The position of the tab is easily controlled by sliding the stick or coil of tabs forward or rearward using a thumb or forefinger that has been extended through the slot or the means for advancing the stick of tabs disposed on one side of the tube that accommodates the stick or coil of tabs. As the tab is pressed on to the tab-holder, the upper edge or upper lip of the outlet of the tube presses the front display wall of the tab and the tab is thereafter pushed on to the tab-holder.

The present invention lends itself to an improved and faster method of manufacturing garment hangers with size-indicating tabs. A garment hanger with a tab-holding section as described above is provided and the assembly-line worker uses an applicator as described above to advance the stick of tabs in one tube forward so that one tab extends out of the outlet. Then the tab is aligned with the tab-holder of the garment hanger and pushed on to the tab-holder using the upper edge of the tube. The pushing action of the upper edge of the tube against the front display wall of the tab and the natural angled position assumed by the applicator results in the breaking of the tab off of the stick of tabs accommodated within the tube. The applicator is then withdrawn and the process is repeated on the next garment hanger.

It is therefore an object of the present invention to provide an improved applicator for attaching size-indicating tabs on garment hangers.

Yet another object of the present invention is to provide an improved system comprising a garment hanger equipped to accommodate size-indicating tabs, an improved size-indicating tab provided in stick or coil form and an applicator that facilitates the attachment of the tabs on the garment hangers.

Yet another object of the present invention is to provide an improved method of manufacturing garment hangers equipped with size-indicating tabs.

BRIEF DESCRIPTION OF THE DRAWINGS

This invention is illustrated more or less diagrammatically in the accompanying drawings, wherein.

Figure 8:
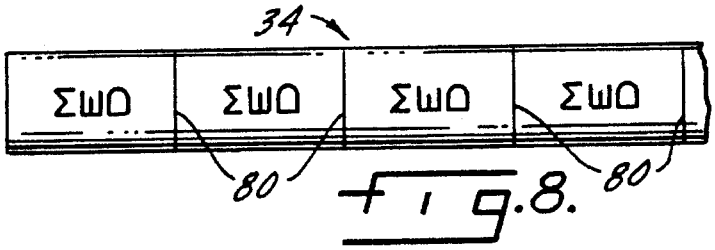
FIG. 8 is a partial side plan view of a strip or coil of size-indicating tabs made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawings.

The contribution made by the present invention can be best understood after consideration of how size-indicating tabs are currently attached to garment hangers. The most popular size-indicating tabs are small and are attached to the portion of the garment hanger where the hook is mounted to the base of the hanger. Because consumers are now demanding size-indicating tabs that are irremovable, the tabs must snap on to a tab-holding section of the hanger. Accordingly, a small article must be snapped on to a small section of a garment hanger. In terms of the speed required in a factory setting, this cumbersome task is time-consuming and will often slow down the manufacturing process thereby increasing the cost of manufacture. Accordingly, an improved applicator system is needed for mounting the size-indicating tabs on to the garment hangers.

Figure 1:
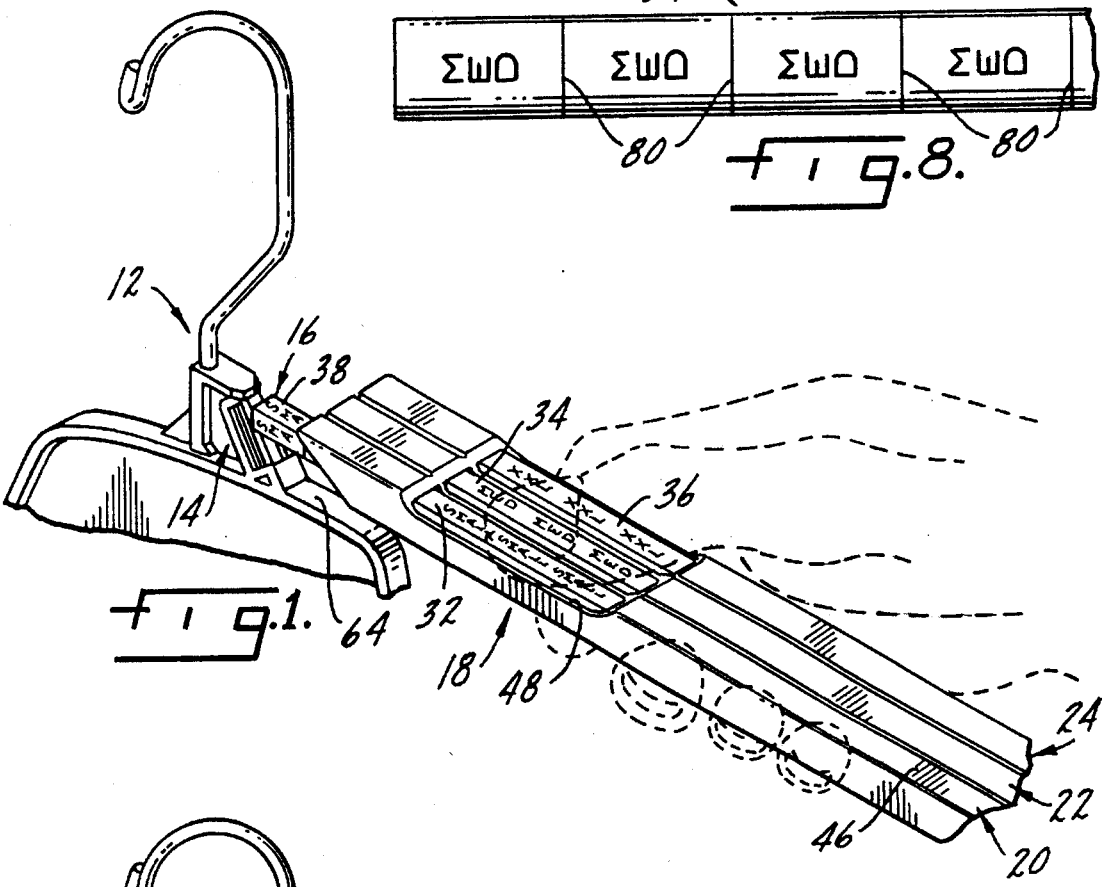
FIG. 1 is a perspective view illustrating the use of an applicator made in accordance with the present invention to install a size-indicating tab on a garment hanger.

As seen in FIG. 1, the garment hanger 12 is equipped with a tab-holding section 14. A size-indicating tab 16 is attached to the tab-holding section 14 with the assistance of the applicator 18. The applicator 18 is a hand-held device that is easy to use. In the embodiment shown in FIG. 1, the applicator 18 includes three tubes 20, 22, 24. Each tube features an outlet 26, 28, 30 (see FIG. 5) through which a tab 16 may be extended. The tab 16 is extended through an outlet such as 26 by engaging a strip or coil of tabs such as the ones shown at 32, 34 or 36 in FIG. 1 and pushing the tabs forward until a tab such as 16 extends through an outlet 26 and is ready to be mounted on to the tab-holding section 14 of a garment hanger 12.

Figure 2:
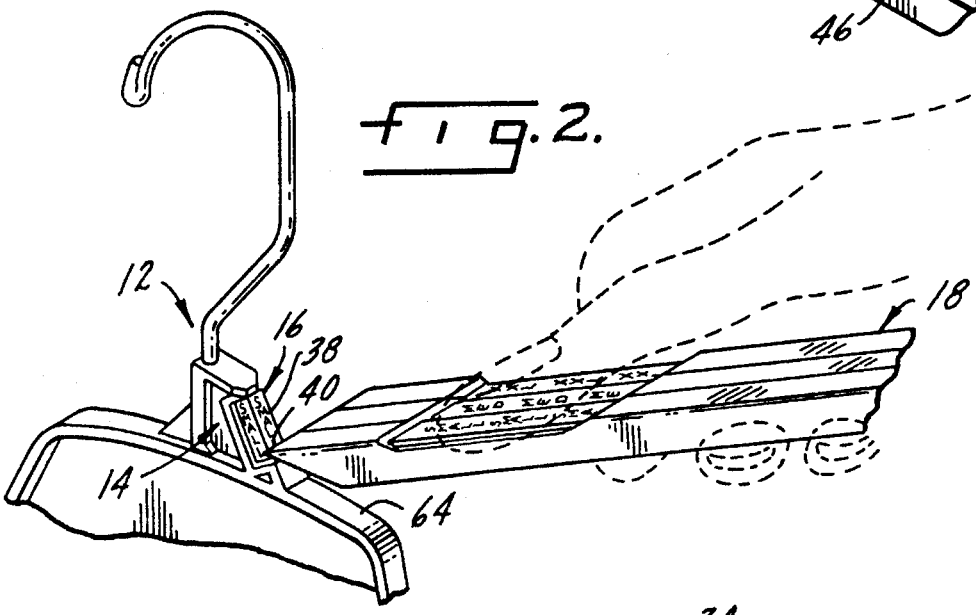
FIG. 2 is another perspective view illustrating the use of an applicator made in accordance with the present invention particularly illustrating the use of the upper lip or ledge of the outlet of the applicator to push the size-indicating tab on to the tab-holder of the garment hanger.

Referring to FIGS. 1 and 2 collectively, the operator engages a stick or coil of tabs 32 and pushes the stick 32 forward within the tube 20 so that a single tab 16 extends out of the outlet 26. After the operator has lined up the tab 16 with the tab-holding section 14 of the hanger 12, the operator moves the tab 16 forward into position on the tab-holding section 14. Turning to FIG. 2, the operator then pushes forward and slightly downward to push the tab 16 on to the tab-holding section 14 thereby engaging the front display surface 38 of the tab with the upper edge 40 of the outlet 26 of the tube 20. By pushing against the front display surface 38 with the upper edge 40 of the outlet 26 of the tube 20, the operator pushes the tab 16 on to the tab-holding section 14 and bends it upward into place thereby snapping the connection between the tab 16 and the remaining stick or coil of tabs 32 still maintained within the tube 20. The operator then slides one of the stick or coil of tabs 32, 34 or 36 forward so that the next garment hanger may be fitted with a size-indicating tab.

Figures 3, 4, 5, 6, 7, 10:
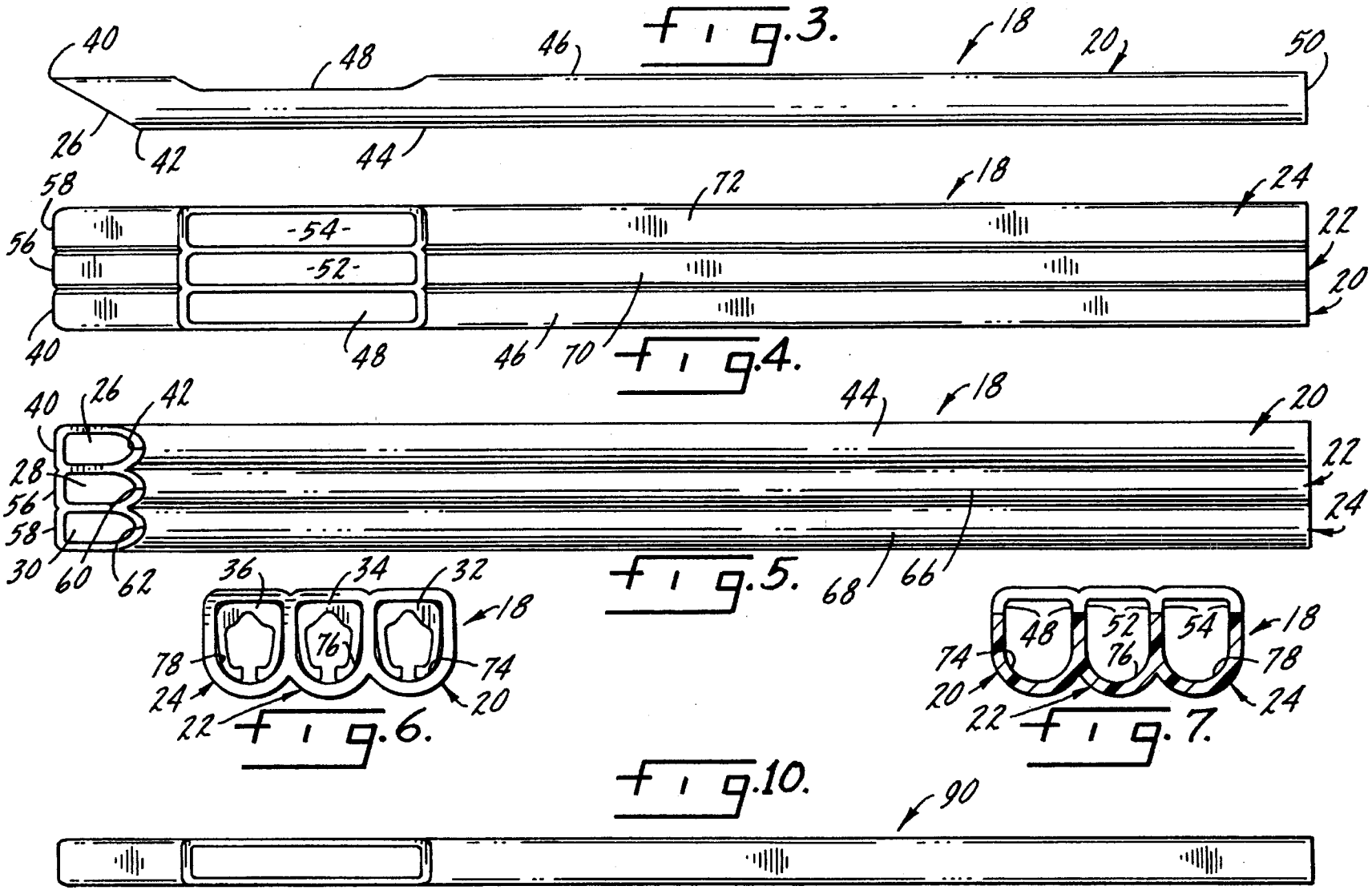
FIG. 3 is a side plan view of a size-indicating tab applicator made in accordance with the present invention.
FIG. 4 is a top plan view of the applicator and tabs of FIG. 3.
FIG. 5 is a bottom plan view of the applicator shown in FIGS. 1 and 3.
FIG. 6 is a front end view of the applicator and tabs of FIGS. 1 and 3.
FIG. 7 is a rear end view of the applicator shown in FIG. 3.
FIG. 10 is a top plan view of yet another applicator made in accordance with the present invention, particularly illustrating a single tube applicator.

Turning to FIG. 3, the tube 20 of the applicator 18 is illustrated. The outlet 26 features an upper edge 40 and lower edge 42. The lower edge 42 is displaced rearwardly of the upper edge 40 to create an angled outlet 26. The rearward angle of the outlet 26 prevents interference between the lower edge 42 and bottom surface 44 of the tube 20 during installation of a tab 16 on a tab-holding section 14 of a garment hanger 12. The upper surface 46 of the tube 20 features a slot or opening 48 which serves as a means for advancing a stick or coil of tabs 32 as illustrated in FIG. 1. The overall shape or contour of the tube 20 may be designed to ergonomically fit the user's hand. The inlet 50 may be modified to accommodate a stick of tabs 32 as shown in FIG. 1 or a longer coil of tabs (not shown).

As seen in FIG. 4, the applicator 18 includes three tubes 20, 22 and 24 that may accommodate small, medium and large size-indicating tabs. The slots or openings 48, 52, 54 are preferably arranged in a side-by-side relationship or juxtaposed relationship in order to facilitate the manipulation of the sticks of tabs 32, 34, 36 with a single finger or thumb of the operator. Each tube 20, 22, 24 is equipped with an upper edge 40, 56, 58 to facilitate the breaking off of a tab, such as the one shown at 16, as it is mounted on to a tab-holding section 14.

The tapered configuration of the outlets is further illustrated in FIG. 4. The lower edges 42, 60, and 62 are disposed rearward of their respective upper edges, 40, 56, 58 thereby avoiding interference between the lower edges 42, 60 and 62 with the shoulder 64 of the garment hanger 12 (see FIGS. 1 and 2) during installation of the tab 16 on to the tab-holding section 14. As seen in FIGS. 1 and 2, the lower surfaces 44, 66, 68 remain above the shoulder 64 of the garment hanger 12 during installation of the tab 16. As noted above, the lower surfaces 44, 66, 68 and upper surfaces 46, 70, 72 may be designed to ergonomically fit in the user's hand.

Turning to FIG. 6, the interior surfaces 74, 76, 78 are configured to snugly accommodate the sticks of tabs 32, 34, 36 so as to prevent any twisting or rolling of the sticks 32, 34, 36 inside the tubes 20, 22, 24.

Figure 9:
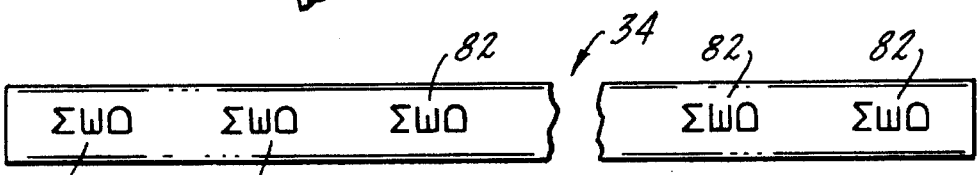
FIG. 9 is a partial top plan view of the size-indicating tabs shown in FIG. 8.

FIG. 8 is an illustration of a stick of tabs such as 34 illustrating the slits 80 cut in the side members of the tabs to facilitate the breaking off or separation of the tabs as they are mounted on to the tab-holding section of the hanger 12 as illustrated in FIGS. 1 and 2. FIG. 9 is a top view or view of the front display surfaces 82 of the stick of tabs 34 that are connected together and that break off after the front display surface 82 is engaged by the upper edge 56 of the tube 22 during installation of the tab onto the tab-holding section 14 as illustrated in FIGS. 1 and 2 with respect to the strip of tabs 32.

FIG. 10 illustrates a single-tube applicator 90 as opposed to the three-tube applicator 18 discussed above. Thus, an improved applicator 18 or applicator 90 is provided that facilitates the application of size-indicating tabs such as the one shown at 16 on to tab-holding sections 14 of garment hangers 12. The operator no longer has to manipulate a small size-indicating tab, line the tab up with his/her fingers and manually insert the tab on to the hanger. The applicators 18 and 90 greatly increase the speed in which the installation procedure is carried out.

Although only two preferred embodiments of the present invention have been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

We claim:

1. A combination of an applicator for attaching size-indicating tabs to garment hangers and size-indicating tabs in stick form for attachment to said garment hangers by said applicator, the combination comprising:

the tabs being provided in sticks of tabs connected to one another in an end-to-end fashion, each stick of tabs indicating a garment size;

the applicator including a plurality of tubes connected in a side-by-side fashion;

each tube including an open inlet and an open outlet through which a stick of tabs extends, the outlets being disposed in a side-by-side relationship to one another;

each outlet including an upper edge and a lower edge, the upper edge being disposed forward of the lower edge to enable a tab to be pushed onto the garment hanger, the outlet extending rearward and terminating at the lower edge;

each tube including an opening disposed through an upper side thereof and inwardly from the upper edge thereof, each opening providing access to the stick of tabs disposed in the tube; and each tube including an interior surface for accommodating the stick of tabs and precluding rotation of the stick of tabs inside the tube.

2. A combination garment hanger and an applicator for attaching a size-indicating tab to the garment hanger, the combination comprising:

the garment hanger including a hang means;

a garment support member connected to the hang means;

a tab-holder disposed between the garment support member and the hang means;

a wall connecting the tab-holder to the hanger, the wall extending frontward along one side of the garment support member and terminating at the tab-holder;

the tab-holder extending frontward and terminating at a tapered front end;

the applicator including at least one tube;

each tube including an outlet;

each tube including means for advancing the stick of tabs so one tab extends through the outlet for mounting onto the tab-holding section of the garment hanger;

each tube including an interior surface for accommodating the stick of tabs and precluding rotation to the stick of tabs inside the tube;

each outlet includes an upper edge and a lower edge;

each upper edge being disposed forward of the lower edge to push the tab onto the tab-holding section of the garment hanger;

each outlet extending rearward and terminating at the lower edge;

each lower edge being configured so as to not interfere with the garment support member of the garment hanger when a tab is being pushed onto a tab-holding section.

3. A method of installing size-indicating tabs on garment hangers utilizing an applicator, the method comprising the steps of:

a) providing a garment hanger including a hang means;

a garment support member connected to the hang means;

a tab-holder disposed between the garment support member and the hang means;

a wall connecting the tab-holder to the hanger, the wall extending frontward along one side of the garment support member and terminating at the tab-holder;

the tab-holder extending frontward and terminating at a tapered front end;

b) providing the applicator including at least one tube;

each tube including an outlet;

each tube accommodating a stick of tabs;

each tube including means for advancing the stick of tabs so one tab extends through the outlet for mounting onto the tab-holding section of the garment hanger;

each tube including an interior surface accommodating the stick of tabs and precluding rotation to the stick of tabs inside the tube;

each outlet includes an upper edge and a lower edge;

each upper edge being disposed forward of the lower edge to push the tab onto the tab-holding section of the garment hanger;

each outlet extending rearward and terminating at the lower edge;

each lower edge being configured so as to not interfere with the garment support member of the garment hanger when a tab is being pushed onto a tab-holding section;

c) advancing the stick of tabs in one tube forward so one tab extends outward from its respective outlet;

d) aligning the one tab extending outward from its respective outlet with the tab-holder of the garment hanger;

e) pushing the one tab onto the tab-holder with the upper edge of its respective tube;

f) breaking the one tab off of the stick of tabs with the upper edge of its respective tube; and g) withdrawing the applicator.

4. A combination of an applicator for attaching a size-indicating tab and a stick of size-indicating tabs, the combination comprising:

three tubes connected in a side-by-side relationship to each other;

each tube including an outlet;

each tube accommodating a stick of tabs, each stick of tabs being labeled with different indicia, the tabs of each stick being connected to one another in an end-to-end fashion;

each tube including means for advancing its respective stick of tabs so one tab extends through its respective outlet;

each tube including an interior surface for accommodating its respective stick of tabs and precluding rotation to the stick of tabs inside the tube;

each outlet includes an upper edge and a lower edge;

each upper edge being disposed forward of its respective lower edge to push the tab forward;

each outlet extending rearward and terminating at the lower edge.

5. The combination of claim 4, wherein each means for advancing the stick of tabs is a slot disposed in the tube rearward of the outlet, the slot providing access to the stick of tabs by a finger thereby enabling a user to push the stick of tabs forward toward the outlet.

6. A combination garment hanger, applicator for attaching a size-indicating tab to the garment hanger and size-indicating tabs provided in stick form, the combination comprising:

the garment hanger including a tab-holding section for accommodating at least one size-indicating tab;

the applicator including at least one tube;

each tube including an outlet;

each tube including means for advancing the stick of tabs so one tab extends through the outlet for mounting onto the tab-holding section of the garment hanger;

each tube including an interior surface for accommodating the stick of tabs;

means for advancing the stick of tabs so one tab extends through the outlet;

the stick of tabs comprising a plurality of tabs connected to one another in an end-to-end fashion.

7. A combination garment hanger, applicator for attaching a size-indicating tab to the garment hanger and size-indicating tabs provided in stick form, the combination comprising:

the garment hanger including a tab-holding section for accommodating at least one size-indicating tab;

the applicator including at least three tubes, each tube accommodating one stick of tabs;

each tube including an outlet;

each tube including means for advancing the stick of tabs accommodated therein so one tab extends through the outlet for mounting onto the tab-holding section of the garment hanger;

each tube including an interior surface for accommodating the stick of tabs;

means for advancing the stick of tabs so one tab extends through the outlet;

each stick of tabs comprising a plurality of tabs connected to one another in an end-to-end fashion, each stick of tabs carrying indicia indicating different sizes.

8. A method of installing size-indicating tabs on garment hangers utilizing an applicator, the method comprising the steps of:

a) providing a garment hanger including a tab-holding section;

b) providing the applicator including at least one tube;

each tube including an outlet;

each tube accommodating a stick of tabs;

each tube including means for advancing the stick of tabs so that one tab extends through the outlet for mounting onto the tab-holding section of the garment hanger;

each tube including an interior surface accommodating the stick of tabs and precluding rotation to the stick of tabs inside the tube;

each outlet including an edge for pushing the tab onto the tab-holding section of the garment hanger;

c) providing one stick of tabs per tube, each stick of tabs comprising a plurality of tabs connected to one another in an end-to-end fashion;

d) advancing the stick of tabs in one tube forward so one tab extends outward from its respective outlet;

e) aligning the one tab extending outward from its respective outlet with the tab-holding section of the garment hanger;

f) pushing the one tab onto the tab-holding with the edge of its respective outlet;

g) breaking the one tab off of the stick of tabs with the edge of its respective outlet; and h) withdrawing the applicator.

9. A method of installing size-indicating tabs on garment hangers utilizing an applicator, the method comprising the steps of:

a) providing a garment hanger including a tab-holding section;

b) providing the applicator including a plurality of tubes connected in a side-by-side relationship to each other;

each tube including an outlet;

each tube accommodating a stick of tabs carrying different size-indicating indicia;

each tube including means for advancing the stick of tabs so that one tab extends through the outlet for mounting onto the tab-holding section of the garment hanger;

each tube including an interior surface accommodating the stick of tabs and precluding substantial rotation to the stick of tabs inside the tube;

each outlet including an edge for pushing the tab onto the tab-holding section of the garment hanger;

c) providing one stick of tabs per tube, each stick of tabs comprising a plurality of tabs connected to one another in an end-to-end fashion;

d) advancing one stick of tabs in one tube forward so one tab extends outward from its respective outlet;

e) aligning the one tab extending outward from its respective outlet with the tab-holding section of the garment hanger;

f) pushing the one tab onto the tab-holding with the edge of its respective outlet;

g) breaking the one tab off of the stick of tabs with the edge of its respective outlet; and h) withdrawing the applicator.

10. A combination of an applicator for attaching a size-indicating tab to a garment hanger and a stick of size-indicating tabs for attachment to said garment hanger by said applicator, the combination comprising:

the tabs being provided in a stick of separable tabs connected to one another in end-to-end fashion as they enter and move through the applicator, the applicator including a tube, the tube including on outlet through which a lead tab exits in the process of being attached to a garment hanger, the outlet includes an upper edge and a lower edge, the upper edge being disposed forward of the lower edge to enable a lead tab to be pushed downward onto the garment hanger while the lower edge pushes upward on a following tab that is connected to the lead tab, the downward force imposed on the upper edge of the lead tab in combination with the upward force imposed by the lower edge of the following tab acting to detach the lead tab from the following tab when the lead tab is pushed downward onto the garment hanger, the tube including an inlet for receiving a stick of tabs connected in end-to-end relationship whereby an additional following tab may enter the tube as each lead tab exits the applicator through the outlet, the tube including means for enabling said stick of connected tabs to be maintained in connected relationship until each lead tab is separated from the stick at the outlet of the tube, the tube including means for advancing the stick of tabs so a lead tab extends through the outlet for mounting onto the garment hanger, and the tube including an interior surface for accommodating the stick of tabs and precluding rotation of the stick of tabs inside the tube.

11. The applicator of claim 10, wherein the means for advancing the stick of tabs is an opening disposed in the tube rearward of the outlet, the opening providing access to the stick of tabs by a finger thereby enabling a user to push the stick of tabs forward toward the outlet.

12. The applicator of claim 10, wherein the applicator comprises three tubes connected in a side-by-side relationship to each other;

each tube including an outlet, the outlets being disposed in a side-by-side relationship to each other;

each tube including means for advancing the stick of tabs so one tab extends through the outlet of its respective tube for mounting onto the garment hanger.

13. The applicator of claim 12, wherein each means for advancing the stick of tabs is an opening disposed in the tube rearward of the outlet, the opening providing access to the stick of tabs by a finger thereby enabling a user to push the stick of tabs forward toward the outlet.

14. The combination of an applicator for attaching size-indicating tabs to garment hangers and a plurality of size-indicating tabs provided in a stick of separable tabs connected to one another in an end-to-end fashion as they move through the applicator, the combination comprising:

a tube;

the tube including an inlet and outlet;

a plurality of size-indicating tabs, the tabs being detachably connected to one another in an end-to-end fashion, from the inlet to the outlet of the tube;

the outlet includes an upper edge and a lower edge;

the upper edge being disposed forward of the lower edge to enable the tab to be secured to structure beneath the tab;

the outlet extending rearward and terminating at the lower edge.

15. The combination of claim 14, further including means for advancing a lead tab, said advancing means being an opening disposed in the tube rearward of the outlet, the opening providing access to the plurality of tabs by a finger thereby enabling a user to push the lead tab forward toward the outlet.

16. The combination of claim 14, wherein the applicator comprises three tubes connected in a side-by-side relationship to each other;

each tube including an outlet, the outlets being disposed in a side-by-side relationship to each other;

each tube including means for advancing the plurality of tabs so that one tab extends through the outlet of its respective tube, each tube accommodating a plurality of tabs, each plurality of tabs in each tube being labeled with different indicia.

17. The combination of claim 16, wherein each means for advancing the stick of tabs is an opening disposed in the tube rearward of the outlet, the opening providing access to the plurality of tabs by a finger thereby enabling a user to push the plurality of tabs forward toward the outlet.

18. The combination of claim 17, wherein each outlet includes an upper edge and a lower edge;

each upper edge being disposed forward of its respective lower edge to push the tab forward;

each outlet extending rearward and terminating at the lower edge.

* * * * *